US005732511A

United States Patent [19]

Scott

[11] Patent Number: 5,732,511

[45] Date of Patent: Mar. 31, 1998

[54] ROOF MOUNTED FIRE PROTECTION SYSTEM

[76] Inventor: Jackie May Scott, 1560 Oak St., Solvang, Calif. 93463

[21] Appl. No.: 732,697

[22] Filed: Oct. 18, 1996

[51] Int. Cl.[6] ..... A62C 3/02; A62C 37/40

[52] U.S. Cl. ..... 52/1; 52/168; 169/13; 169/16; 239/208; 239/209

[58] Field of Search ..... 52/1, 168; 169/13, 169/16; 239/207–209; 137/357, 358

[56] References Cited

U.S. PATENT DOCUMENTS

| | | | |
|---|---|---|---|
| 1,620,142 | 3/1927 | Thompson | 239/208 |
| 1,644,603 | 10/1927 | O'Neill | 169/16 |
| 1,831,880 | 11/1931 | Pierce | 239/208 X |
| 1,837,322 | 12/1931 | Hamilton | 239/208 X |
| 2,865,674 | 12/1958 | Jelmelnod | 239/208 |
| 3,179,181 | 4/1965 | Banzato | 169/13 |
| 3,583,490 | 6/1971 | McFadden | 169/16 X |
| 4,330,070 | 5/1982 | Ence et al. | 239/209 X |
| 4,372,493 | 2/1983 | Smith | 239/208 |
| 4,428,434 | 1/1984 | Gelaude | 169/13 |
| 5,125,458 | 6/1992 | Berman | 169/16 |
| 5,165,482 | 11/1992 | Smagac et al. | 169/45 |
| 5,263,543 | 11/1993 | Nigro | 169/16 X |

*Primary Examiner*—Robert Canfield

[57] ABSTRACT

A roof mounted fire protection system adapted for use in association with a house positioned upon a yard, the house having a pitched roof with an apex and a side wall, the apparatus comprising: a horizontal roof pipe and a vertical side pipe, the horizontal roof pipe being coupled along the apex of the roof, the vertical side pipe having an upper end and a lower end and affixed to the side wall of the house, the upper end of the vertical side pipe being coupled to the horizontal pipe; a plurality of upwardly directed sprinkler heads, each sprinkler head being formed in a generally conical configuration and coupled to the horizontal roof pipe; a pump including an intake port and an output port, the intake port being coupled to a water source, the output port being coupled to the lower end of the vertical pipe; and an activation device operatively coupled to the pump, the activation device enabling a user to activate the pump to supply water to the sprinkler heads when required.

8 Claims, 4 Drawing Sheets

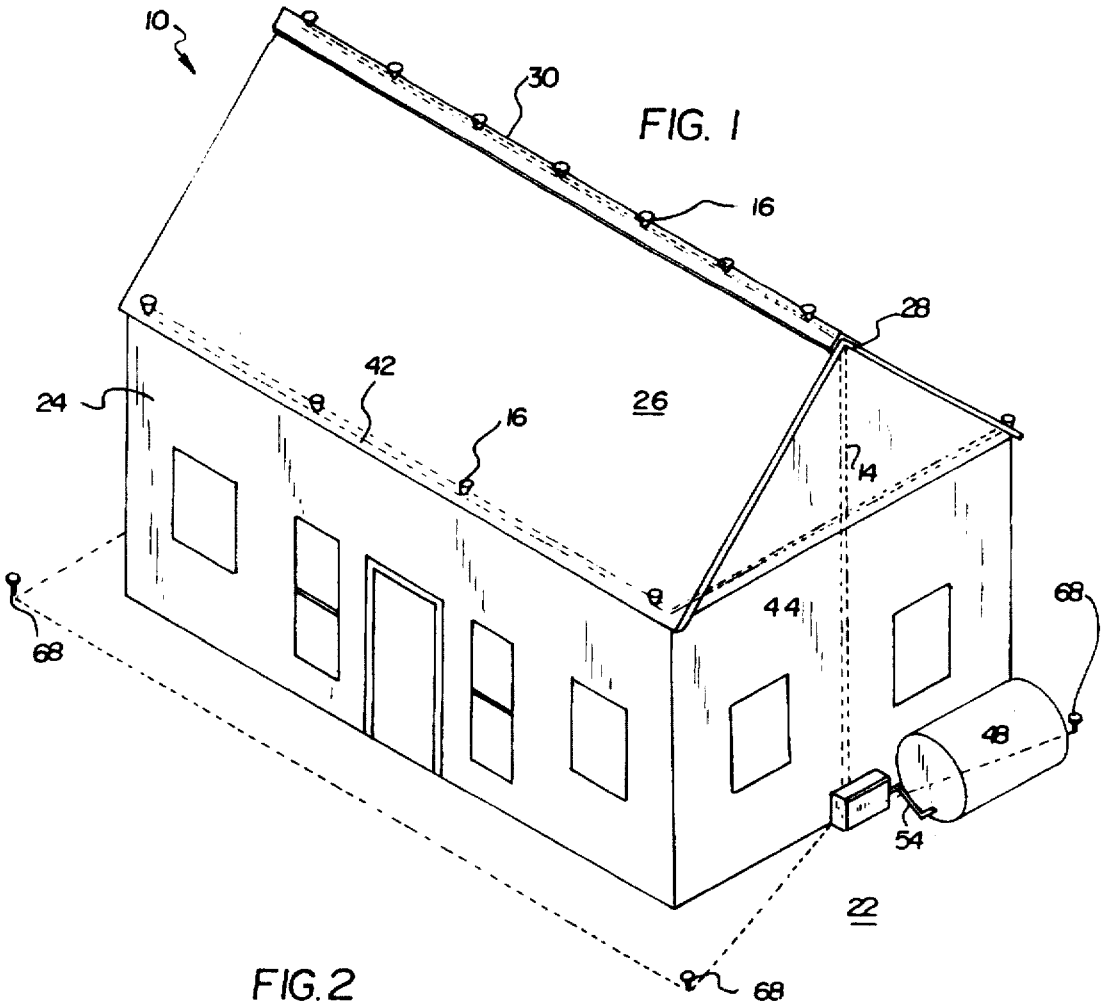
FIG. 1
FIG. 2
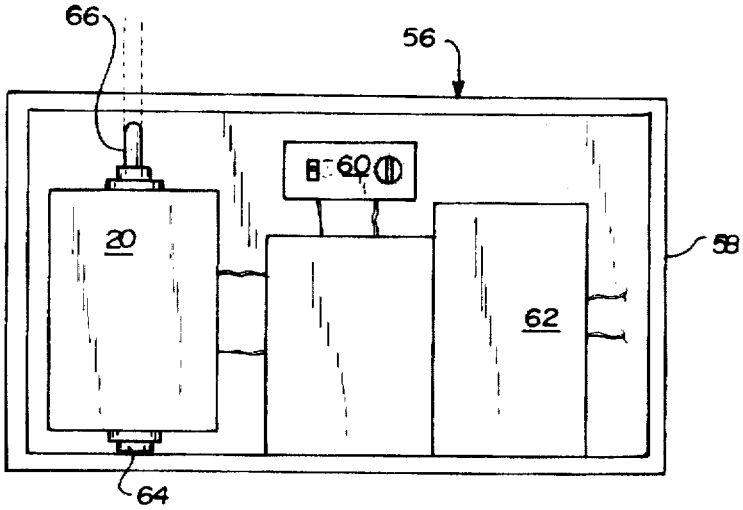

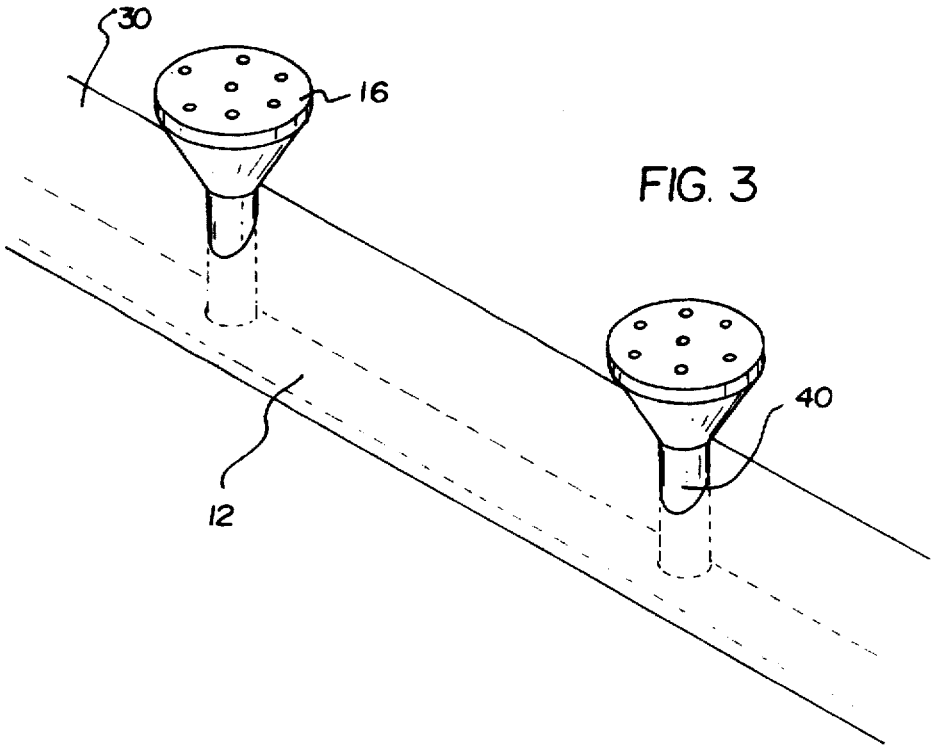
FIG. 3
FIG. 4
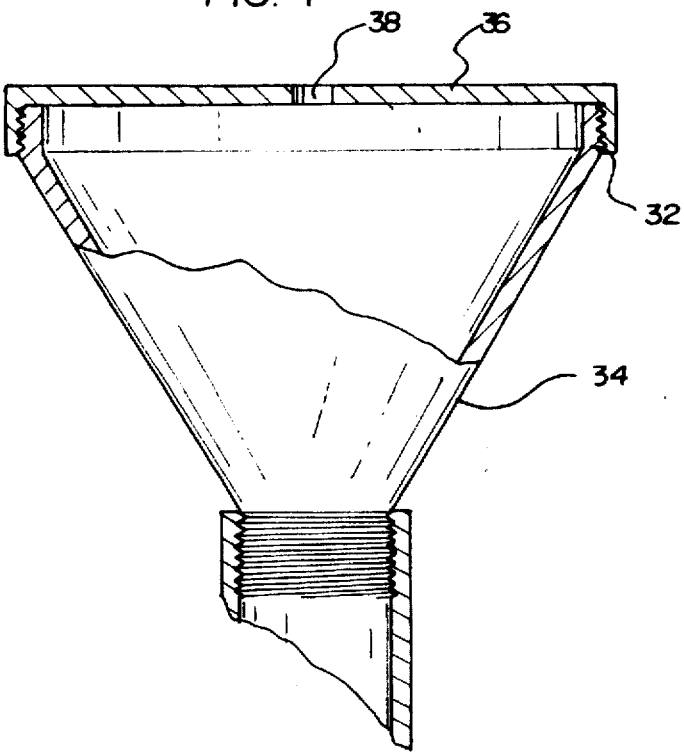

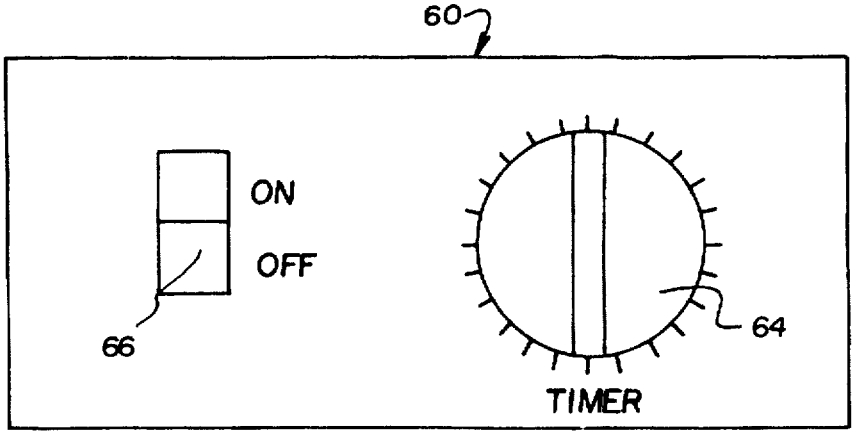
FIG. 5
FIG. 6
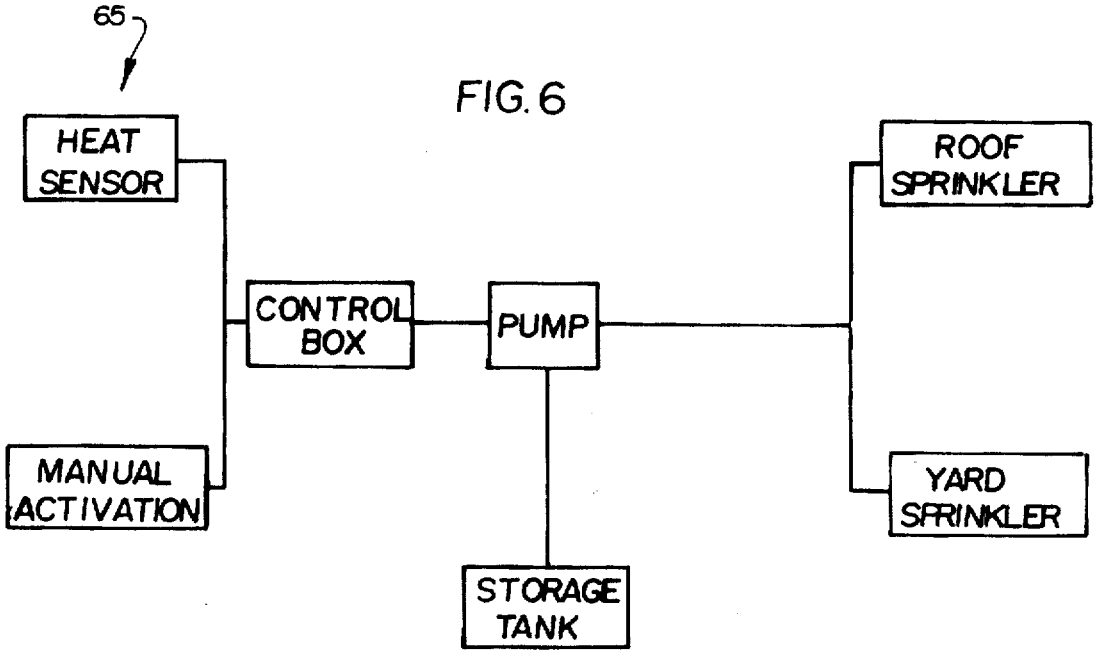

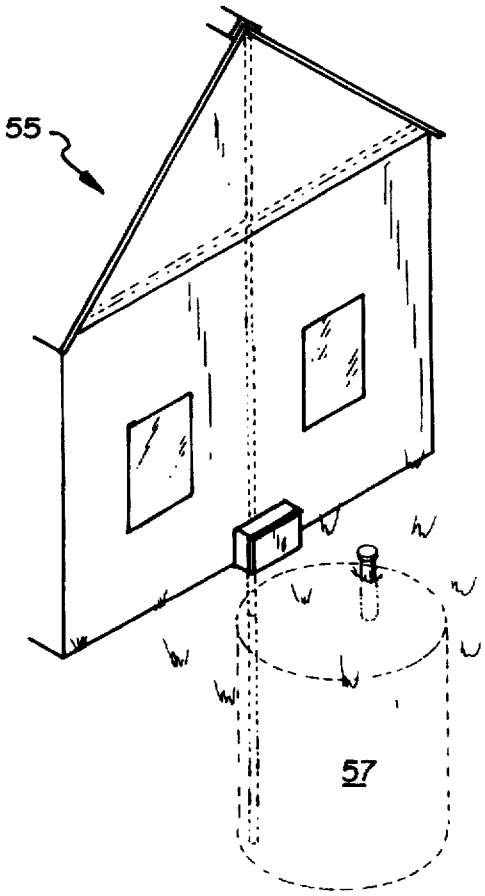
FIG. 7
FIG. 8
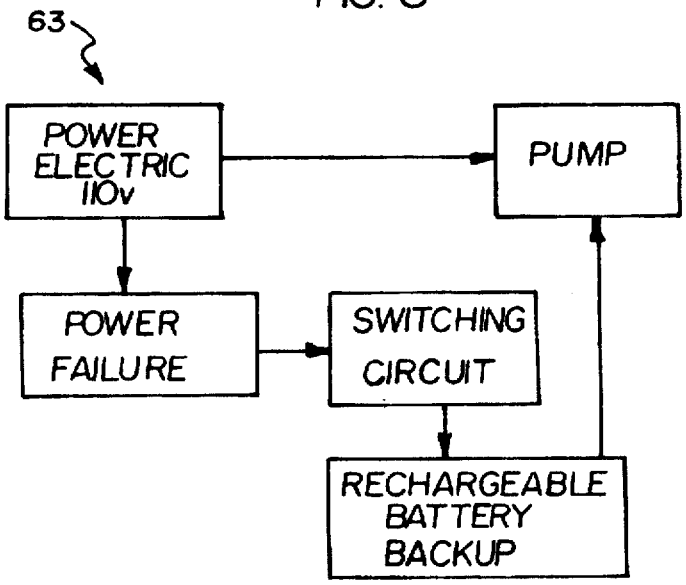

ROOF MOUNTED FIRE PROTECTION SYSTEM

BACKGROUND OF THE INVENTION

1. Field of the Invention

The present invention relates to a roof mounted fire protection system and more particularly pertains to extinguishing house and yard fires with water supplied sprinkler heads mounted to the roof of the house.

2. Description of the Prior Art

The use of fire suppression devices is known in the prior art. More specifically, fire suppression devices heretofore devised and utilized for the purpose of suppressing fires are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,428,434 to Gelaude discloses an automatic fire protection system.

U.S. Pat. No. 4,491,657 to LeLande, Jr. discloses a fire suppression system.

U.S. Pat. No. Des. 343,888 to Rupp discloses a fire fighter water manifold.

U.S. Pat. No. 5,165,482 to Smagac et al. discloses a fire deterrent system for structures in a wildfire hazard area.

U.S. Pat. No. 5,083,618 to Hayes discloses a bush fire protection of buildings.

U.S. Pat. No. 4,858,395 to McQuirk discloses fire protection for structures.

U.S. Pat. No. 5,366,021 to Coleman discloses fire fighting equipment for use in association with homes equipped with swimming pools.

While these devices fulfill their respective, particular objective and requirements, the aforementioned patents do not describe a roof mounted fire protection system for extinguishing house and yard fires with water supplied sprinkler heads mounted to the roof of the house.

In this respect, the roof mounted fire protection system according to the present invention substantially departs from the conventional concepts and designs of the prior art, and in doing so provides an apparatus primarily developed for the purpose of extinguishing house and yard fires with water supplied sprinkler heads mounted to the roof of the house.

Therefore, it can be appreciated that there exists a continuing need for new and improved roof mounted fire protection system which can be used for extinguishing house and yard fires with water supplied sprinkler heads mounted to the roof of the house. In this regard, the present invention substantially fulfills this need.

SUMMARY OF THE INVENTION

In the view of the foregoing disadvantages inherent in the known types of fire suppression devices now present in the prior art, the present invention provides an improved roof mounted fire protection system. As such, the general purpose of the present invention, which will be described subsequently in greater detail, is to provide a new and improved roof mounted fire protection system and method which has all the advantages of the prior art and none of the disadvantages.

To attain this, the present invention essentially comprises a new and improved A new and improved roof mounted fire protection system comprising, in combination: a yard formed of subterranean dirt and an upper surface including a grass lawn; a house including a plurality of side walls and a roof formed in an inverted V-shaped configuration, the roof having front and rear sections each including lower edges, a centrally positioned apex defining the highest point of the roof, the house being positioned upon the upper surface of the yard; a horizontal roof pipe and a vertical side pipe, each pipe being formed in an elongated cylindrical configuration with a hollow interior, the horizontal roof pipe being coupled along the apex of the roof and including a plurality of apertures extending therein, a roof bracket formed in an inverted V-shaped configuration, the roof bracket being positioned over the roof pipe and secured to the roof of the house, the roof bracket including a plurality of apertures positioned in alignment with the apertures of the roof pipe, the vertical side pipe having an upper end and a lower end and coupled to a first side wall of the house, the upper end of the vertical side pipe being coupled to the horizontal roof pipe; a plurality of upwardly directed sprinkler heads, each sprinkler head being formed in a generally conical configuration with an open outboard end and an open inboard end, the outboard end of each sprinkler head having a larger diameter than the inboard end with a gradually decreasing diameter therebetween, a plurality of caps each formed in a planar circular configuration being coupled over the open outboard end of a sprinkler head, a plurality of connecting pipes each having a first end coupled to a sprinkler head and a second end coupled through an aperture of the roof pipe; lower pipes being positioned horizontally and coupled to the lower edge of the front and rear sections of the roof, each lower pipe being coupled to the vertical pipe, a plurality of upwardly directed yard sprinkler heads being coupled to the lower pipes; a storage tank being positioned upon the yard, the storage tank being formed in a generally cylindrical configuration, in an operative orientation the storage tank being filled with water, a tank pipe having an inner end coupled within the storage tank and an outer end coupled to the vertical pipe; and a water supply assembly including a weatherproof cabinet, an electric pump, a control box and a power source, the power source being operatively coupled to the electrical system of the house, the power source including a battery backup, the weatherproof cabinet being formed in an essentially hollow generally rectangular configuration and positioned upon the upper surface of the yard adjacent to the house, the pump being electrically coupled and positioned within the cabinet, the pump including intake and output ports, the outer end of the tank pipe being coupled to the intake port of the pump, the lower end of the vertical pipe being coupled to the output port of the pump, the control box including a timer device, a dial and an on/off switch, the control box being operatively coupled to the pump; heat sensing devices being positioned within the yard and operatively coupled to the control box, with the control box set to the off position the heat sensor devices activating the system when exposed to high temperatures.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved roof mounted fire protection system which has all the advantages of the prior art fire suppression devices and none of the disadvantages.

It is another object of the present invention to provide a new and improved roof mounted fire protection system which may be easily and efficiently manufactured and marketed.

It is a further object of the present invention to provide a new and improved roof mounted fire protection system which is of durable and reliable construction.

An even further object of the present invention is to provide a new and improved roof mounted fire protection system which is susceptible of a low cost of manufacture with regard to both materials and labor, and which accordingly is then susceptible of low prices of sale to the consuming public, thereby making such a roof mounted fire protection system economically available to the buying public.

Still yet another object of the present invention is to provide a new and improved roof mounted fire protection system which provides in the apparatuses and methods of the prior art some of the advantages thereof, while simultaneously overcoming some of the disadvantages normally associated therewith.

Even still another object of the present invention is to provide a new and improved roof mounted fire protection system for extinguishing house and yard fires with water supplied sprinkler heads mounted to the roof of the house.

Lastly, it is an object of the present invention to provide a new and improved a roof mounted fire protection system adapted for use in association with a house positioned upon a yard, the house having a pitched roof with an apex and a side wall, the apparatus comprising: a horizontal roof pipe and a vertical side pipe, the horizontal roof pipe being coupled along the apex of the roof, the vertical side pipe having an upper end and a lower end and affixed to the side wall of the house, the upper end of the vertical side pipe being coupled to the horizontal pipe; a plurality of upwardly directed sprinkler heads, each sprinkler head being formed in a generally conical configuration and coupled to the horizontal roof pipe; a pump including an intake port and an output port, the intake port being coupled to a water source, the output port being coupled to the lower end of the vertical pipe; and an activation device operatively coupled to the pump, the activation device enabling a user to activate the pump to supply water to the sprinkler heads when required.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the roof mounted fire protection system constructed in accordance with the principles of the present invention.

FIG. 2 is an elevational view illustrating the pump and control box positioned within the weatherproof cabinet of the apparatus.

FIG. 3 is an isolated perspective view of two sprinkler heads of the apparatus.

FIG. 4 is a cross sectional view of a sprinkler head of the apparatus.

FIG. 5 is a front perspective view of the control box of the apparatus.

FIG. 6 is a flow chart indicating the sequential operation of the preferred embodiment of the apparatus.

FIG. 7 is a perspective view of an alternate embodiment of the apparatus.

FIG. 8 is a flow chart indicating the sequential operation of an alternate embodiment of the apparatus.

The same reference numerals refer to the same parts through the various Figures.

DESCRIPTION OF THE PREFERRED EMBODIMENT

With reference now to the drawings, and in particular, to FIG. 1 thereof, the preferred embodiment of the new and improved roof mounted fire protection system embodying the principles and concepts of the present invention and generally designated by the reference number 10 will be described.

Specifically, it will be noted in the various Figures that the device relates to a roof mounted fire protection system for extinguishing house and yard fires with water supplied sprinkler heads mounted to the roof of the house. In its broadest context, the device consists of horizontal roof pipe 12, a vertical side pipe 14, a plurality of upwardly directed sprinkler heads 16 and a pump 20. Such components are individually configured and correlated with respect to each other so as to attain the desired objective.

The system includes a conventional yard 22. A house 24 is positioned on the yard and includes a plurality of side walls and a roof 26. The roof is formed in an inverted V-shaped configuration with front and rear sections each having lower edges. A centrally positioned apex 28 defines the highest point of the roof. In alternate embodiments of the apparatus the system does not include a house or yard, but rather is adapted for use in association with an existing house or yard. The system can also be utilized with other free standing structures such as office buildings and apartment complexes. Note FIG. 1.

The system includes a horizontal roof pipe 12 and a vertical side pipe 14. Each pipe is formed in an elongated cylindrical configuration with a hollow interior. The pipes are fabricated of PVC material in the preferred embodiment. In alternate embodiments of the apparatus the pipes are fabricated from one of the following materials: plastic, copper, aluminum, steel. The horizontal roof pipe is coupled along the apex 28 of the roof and includes a plurality of apertures extending within it. The apertures are positioned diametrically opposed from each other. Note FIG. 1.

A roof bracket 30 is formed in an inverted V-shaped configuration. The roof bracket is positioned over the roof pipe 2 and secured to the roof of the house. The roof bracket includes a plurality of apertures positioned in alignment with the apertures of the roof pipe. The vertical side pipe 14 has an upper end and a lower end and is coupled to a first side wall of the house. The upper end of the vertical side pipe is coupled to the horizontal roof pipe 12. Note FIG. 1.

A plurality of upwardly directed sprinkler heads 16 are included with the apparatus. Each sprinkler head is formed in a generally conical configuration with an open outboard end 32 and an open inboard end 34. The outboard end of each sprinkler head has a larger diameter than the inboard end, with a gradually decreasing diameter therebetween. The inboard end 34 includes a plurality of external screw threads. A plurality of caps 36 are each formed in a planar circular configuration and coupled over the open outboard end of a sprinkler head. Each cap includes a plurality of water holes 38 positioned through them. Note FIGS. 3 and 4.

A plurality of connecting pipes 40 each have a first end including internal screw threads and threadedly coupled to a sprinkler head. The connecting pipes each have a second end which is coupled through the bracket and within an aperture of the roof pipe. The upwardly directed configuration of the sprinkler heads allows water to be dispersed over the entire roof of the house in the event of fire. Note FIG. 1, 3 and 4.

The system also includes two horizontally positioned lower pipes 42. Each lower pipe is coupled to the lower edge of the front and rear sections of the roof. Each lower pipe is coupled to the vertical pipe by an auxiliary pipe 44 affixed horizontally to the side wall of the house. Note FIGS. 1 and 4.

An above ground water storage tank 48 is positioned upon the upper surface of the yard. In an operative orientation the storage tank is completely filled with water. A tank pipe 54 has a inner end coupled within the storage tank. The tank pipe has a outer end which is coupled to the intake pipe of the pump. A first alternative embodiment 55 of the apparatus is shown in FIG. 7. In such embodiment the apparatus includes a subterranean tank 57. In alternate embodiments of the apparatus a storage tank is not included with the system. Rather, a swimming pool or public water source is operatively coupled to the system. Note FIGS. 1 and 2.

A water supply assembly 56 includes a weatherproof cabinet 58, a pump 20, a control box 60 and a power source 62. The power source is operatively coupled to the electrical system of the house. The power source 62 includes a battery backup. Note that FIG. 8 depicts a schematic view 63 of the electrical system of the apparatus. In the event of a power failure, a switching circuit directs the flow of current from the rechargeable battery to the pump. Note FIGS. 1 and 8.

The weatherproof cabinet 58 is formed in an essentially hollow generally rectangular configuration and positioned upon the upper surface of the yard adjacent to the house. The pump 20 is electrically powered and positioned within the cabinet. The pump includes intake 64 and output ports 66. The outer end of the tank pipe is coupled to the intake port of the pump. The lower end of the vertical pipe 14 is coupled to the output port of the pump. During operation of the system the pump forces water up the vertical pipe and through the horizontal pipes for distribution through the sprinkler heads 16. Note FIGS. 1 and 3.

The control box 60 includes a timer device, a timer dial 64 and an on/off switch 66. The control box is operatively coupled to the pump. The control box includes incremental markers surrounding the timer dial. When the on/off switch is in the on position, the timer devices activates the apparatus at a predetermined time. Upon activation, water is pumped through the pipes for distribution through the sprinkler heads. FIG. 6 discloses a schematic view 65 of the operational flow of the apparatus. Note FIGS. 5 and 6.

Heat sensing devices 68 are positioned within the yard and operatively coupled to the control box. The seat sensing devices are positioned upon the yard around the house. When the control box is set to the off position the heat sensor devices activate the system when exposed to high temperatures. Note FIG. 1.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A new and improved roof mounted fire protection system comprising, in combination:

a yard formed of subterranean dirt and an upper surface including a grass lawn;

a house including a plurality of side walls and a roof formed in an inverted V-shaped configuration, the roof having front and rear sections each including lower edges, a centrally positioned apex defining the highest point of the roof, the house being positioned upon the upper surface of the yard;

a horizontal roof pipe and a vertical side pipe, each pipe being formed in an elongated cylindrical configuration with a hollow interior, the horizontal roof pipe being coupled along the apex of the roof and including a plurality of apertures extending therein, a roof bracket formed in an inverted V-shaped configuration, the roof bracket being positioned over the roof pipe and secured to the roof of the house, the roof bracket including a plurality of apertures positioned in alignment with the apertures of the roof pipe, the vertical side pipe having an upper end and a lower end and coupled to a first side wall of the house, the upper end of the vertical side pipe being coupled to the horizontal roof pipe;

a plurality of upwardly directed sprinkler heads, each sprinkler head being formed in a generally conical configuration with an open outboard end and an open inboard end, the outboard end of each sprinkler head having a larger diameter than the inboard end with a gradually decreasing diameter therebetween, a plurality of caps each formed in a planar circular configuration being coupled over the open outboard end of a sprinkler head, a plurality of connecting pipes each having a first end coupled to a sprinkler head and a second end coupled through an aperture of the roof pipe;

lower pipes being positioned horizontally and coupled to the lower edge of the front and rear sections of the roof, each lower pipe being coupled to the vertical pipe, a plurality of upwardly directed yard sprinkler heads being coupled to the lower pipes;

a storage tank being positioned upon the yard, the storage tank being formed in a generally cylindrical configuration, in an operative orientation the storage tank being filled with water, a tank pipe having an inner end coupled within the storage tank and an outer end coupled to the vertical pipe; and a water supply assembly including a weatherproof cabinet, an electric pump, a control box and a power source, the power source being operatively coupled to the electrical system of the house, the power source including a battery backup, the weatherproof cabinet being formed in an essentially hollow generally rectangular configuration and positioned upon the upper surface of the yard adjacent to the house, the pump being electrically coupled and positioned within the cabinet, the pump including intake and output ports, the outer end of the tank pipe being coupled to the intake port of the pump, the lower end of the vertical pipe being coupled to the output port of the pump, the control box including a timer device, a dial and an on/off switch, the control box being operatively coupled to the pump;

heat sensing devices being positioned within the yard and operatively coupled to the control box, with the control box set to the off position the heat sensor devices activating the system when exposed to high temperatures.

2. A roof mounted fire protection system in association with a house positioned upon a yard, the house having a pitched roof with an apex and a side wall, the system comprising:

a horizontal roof pipe and a vertical side pipe, the horizontal roof pipe being coupled along the apex of the roof, the vertical side pipe having an upper end and a lower end and affixed to the side wall of the house, the upper end of the vertical side pipe being coupled to the horizontal pipe;

a roof bracket formed in an inverted V-shaped configuration positioned over said horizontal roof pipe to couple the horizontal roof pipe to apex of the roof, said roof bracket provided with a plurality of apertures positioned in alignment with apertures provided in the horizontal roof pipe;

a plurality of upwardly directed sprinkler heads, each sprinkler head being formed in a generally conical configuration and coupled to the horizontal roof pipe;

a pump including an intake port and an output port, the intake port being coupled to a water source, the output port being coupled to the lower end of the vertical pipe; and an activation device operatively coupled to the pump, the activation device enabling a user to activate the pump to supply water to the sprinkler heads when required.

3. The roof mounted fire protection system as set forth in claim 2 wherein the pump is electrically powered.

4. The roof mounted fire protection system as set forth in claim 2 wherein water source is a free standing above ground water storage tank.

5. The roof mounted fire protection system as set forth in claim 2 wherein water source is a subterranean water storage tank.

6. The roof mounted fire protection system as set forth in claim 2 wherein roof of the house includes front and rear lower edges, the system further including:

horizontally positioned lower pipes coupled to the front and rear lower edges of the roof, each lower pipe being coupled to the vertical pipe, a plurality of yard sprinkler heads being coupled to the lower pipes and directed upwardly.

7. The roof mounted fire protection system as set forth in claim 2 wherein the activation device are a plurality of heat sensing devices operatively coupled to the pump and positioned upon the yard.

8. The roof mounted fire protection system as set forth in claim 7 and further including a control box operatively coupled to the pump and heat sensing devices, the control box including a an on/off switch and a timer device.

* * * * *